US007445132B1

(12) United States Patent
Williams

(10) Patent No.: US 7,445,132 B1
(45) Date of Patent: Nov. 4, 2008

(54) SYSTEM FOR DETERMINING GAS CARTRIDGE ACTUATION STATE

(75) Inventor: Michael W. Williams, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 689 days.

(21) Appl. No.: 11/217,857

(22) Filed: Aug. 24, 2005

(51) Int. Cl.
*B67D 5/00* (2006.01)

(52) U.S. Cl. ..... 222/5; 441/93

(58) Field of Classification Search ..... 222/5, 222/23, 80–86; 441/92–95, 101; 141/19
See application file for complete search history.

(56) References Cited

U.S. PATENT DOCUMENTS 3,579,964 A * 5/1971 Ohlstein ..... 222/5
3,596,799 A * 8/1971 Fairchild et al. ..... 222/5
4,166,428 A * 9/1979 Freeman et al. ..... 116/86
4,498,604 A * 2/1985 Mackal ..... 222/5
4,498,605 A * 2/1985 Mackal et al. ..... 222/5
4,768,128 A * 8/1988 Jankowiak et al. ..... 361/251
5,234,015 A * 8/1993 Fumino ..... 137/68.23
5,419,725 A * 5/1995 Crowder et al. ..... 441/10
5,562,233 A * 10/1996 Glasa ..... 222/5
5,852,986 A * 12/1998 Mackal ..... 116/266
6,561,863 B1 * 5/2003 Campbell ..... 441/93
6,589,087 B2 * 7/2003 Mackal et al. ..... 441/93

* cited by examiner

*Primary Examiner*—Lien T Ngo
(74) *Attorney, Agent, or Firm*—James M. Kasischke; Michael P. Stanley; Jean-Paul A. Nasser

(57) ABSTRACT

A gas cartridge actuation state determination system includes a puncture pin adapted to abut an end of the gas cartridge. A load sensor coupled to and in line with the puncture pin. A spring bears against the load sensor. The spring's force is such that it is insufficient to cause the puncture pin to be driven through the end of the gas cartridge when the end has not been punctured, but is sufficient to cause the puncture pin to be driven through the end of the gas cartridge when the end has already been punctured. In addition, the spring's force is such that it will be approximately zero after the puncture pin has been driven through the end that has already been punctured. A device coupled to the load sensor determines when the spring force is approximately zero.

13 Claims, 2 Drawing Sheets

SYSTEM FOR DETERMINING GAS CARTRIDGE ACTUATION STATE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates generally to gas cartridge actuation systems, and more particularly to a system that determines whether a gas cartridge has been punctured or actuated.

(2) Description of the Prior Art

Currently, torpedoes launched from a surface vessel utilize the vessel's high pressure air just prior to launch to (i) mechanically release the torpedo from its weapon securing mechanism, and (ii) detach the torpedo's electrical umbilical. More recently, development efforts have focused on eliminating the use of the vessel's high pressure air for these functions. Specifically, automotive airbag inflator systems have been selected to provide the launch energy source while gas cartridges have been selected to provide the energy to disable the weapon securing mechanism just prior to launch.

With respect to the use of gas cartridges, for safety reasons it is desirable to open such a gas cartridge remotely, i.e., puncture a sealed end of the gas cartridge as is known in the art. After each torpedo launch, the actuated (i.e., punctured) gas cartridges must be manually replaced with a new gas cartridge that has not been previously actuated (i.e., punctured). If a previously punctured cartridge were inadvertently used, a torpedo misfire would result as the torpedo's weapon securing mechanism would not be released and the torpedo's electrical umbilical would not be detached.

SUMMARY OF THE INVENTION

Accordingly, it is an object of the present invention to provide a system that determines whether or not a gas cartridge has been punctured or actuated.

Another object of the present invention is to provide a system that can be incorporated into a gas cartridge actuation system and be used to determine whether or not a gas cartridge has been punctured or actuated.

Other objects and advantages of the present invention will become more obvious hereinafter in the specification and drawings.

In accordance with the present invention, a system determines a gas cartridge's actuation state. A puncture pin is adapted to have a first end thereof positioned to abut an end of the gas cartridge. A load sensor is coupled to and in line with a second end of the puncture pin. A spring having a spring force bears against the load sensor. The spring force is insufficient to cause the puncture pin to be driven through the end of the gas cartridge when the end has not been punctured, but is sufficient to cause the puncture pin to be driven through the end of the gas cartridge when the end has already been punctured. In addition, the spring force is approximately zero after the puncture pin has been driven through the end that has already been punctured. A device coupled to the load sensor determines when the spring force is approximately zero at which point an alarm can be triggered.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DESCRIPTION OF THE PREFERRED EMBODIMENT(S)

Figure 1:
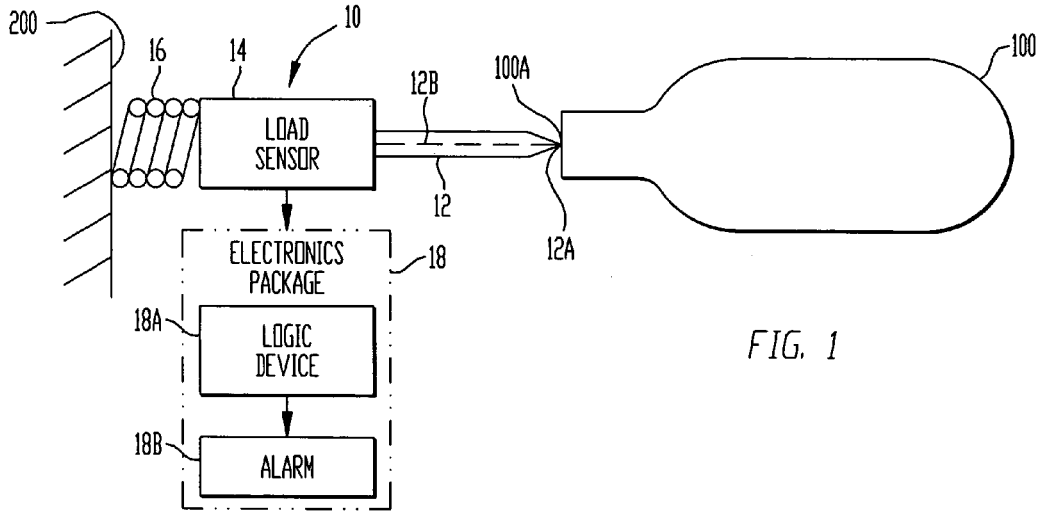
FIG. 1 is a schematic view of a system for determining a gas cartridge's actuation state according to an embodiment of the present invention.

Referring now to the drawings, and more particularly to FIG. 1, a system for determining the actuation state of a gas cartridge 100 is shown schematically and is referenced generally by numeral 10. Gas cartridge 100 is any pressurized gas-containing cartridge having an end 100A designed to be puncturable by application of the requisite amount of force whereby the gas in cartridge 100 is released into the surrounding environment. Accordingly, the term "actuation state" as used herein is indicative of a binary condition where a "non-actuated" state refers to end 100A that has not been punctured (i.e., there is gas in cartridge 100) and an "actuated" state refers to end 100A that has already been punctured (i.e., there is no gas in cartridge 100).

The basic structural elements of system 10 include a pin 12, a load sensor 14, a spring 16, and an electronics package 18. Pin 12 is any rigid element having a tip 12A capable of puncturing end 100A when a sufficient force is applied to pin 12. Typically, the force will be applied along the longitudinal axis 12B of pin 12. Pin 12 is positioned such that tip 12A abuts end 100A. Load sensor 14 is coupled to pin 12. Load sensor 14 can be any load cell or other load sensing device capable of sensing/measuring the force being applied to pin 12 along axis 12B. Accordingly, load sensor is typically placed in line with pin 12. Spring 16 bears against and is in line with load sensor 14. In this simple illustration, one end of spring 16 bears against load sensor 14 while spring 16 is held in its compressed or stored-energy state as its opposite end bears against a platform 200.

In the compressed state, spring 16 imparts a spring force $F_S$ to load sensor 14 which, in turn, is applied along axis 12B of pin 12. Spring 16 is selected such that spring force $F_S$ is far less than that required to be applied to pin 12 to puncture end 10A. However, spring force $F_S$ must be sufficient to drive pin 12 through end 100A if end 100A was previously punctured. Further, spring 16 is selected such that spring force $F_S$ is zero (or approximately so) after pin 12 has been driven through a previously-punctured end 100A. That is, spring 16 is only long enough and strong enough to drive pin 12 into an existing puncture hole in end 100A, at which point spring force $F_S$ becomes negligible or zero.

Electronics package 18 is coupled to load sensor 14 to monitor the output thereof. In terms of monitoring the actuation state of gas cartridge 100, load sensor 14 will sense spring force $F_S$ which will be one of (i) equal to the compressed-state spring force of spring 16 when end 100A is not punctured, or (ii) zero (or approximately so) if spring 16 has been released from its compressed state as will be the case when end 100A has already been punctured. Accordingly, electronics package 18 can include a logic device 18A for recognizing the non-actuated or actuated state indicated by the output of load sensor 14. Such logic devices are well known in the art and could include analog or digital circuits. An alarm 18B could be coupled to logic device 18A for issuing an alarm signal when logic device 18A recognized an actuated state of gas cartridge 100. The alarm signal could be realized by one or more of a visual alarm, an audio alarm, and a tactile alarm.

Figure 2:
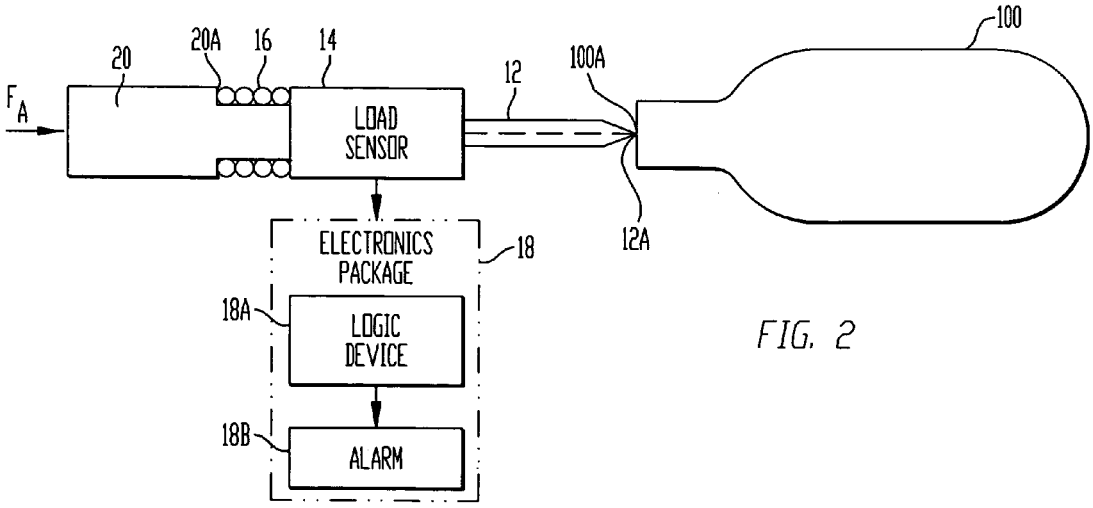
FIG. 2 is a schematic view of a system of the present invention incorporated into a gas cartridge actuation system.

The present invention can be easily incorporated into any existing gas cartridge actuation system. For example, FIG. 2 illustrates the previously-described elements of system 10 coupled to a drive piston 20 to which an actuation force $F_A$ is applied when end 100A is to be punctured so that gas in cartridge 100 can be released. In this embodiment, spring 16 is held in its compressed state as it bears between an annular shoulder 20A of piston 20 and load sensor 14. Further, in the compressed state of spring 16, drive piston 20 is in contact with load sensor 14, but is not coupled thereto. As a result, prior to the application of actuation force $F_A$, spring 16 can drive load sensor 14/pin 12 through end 100A if end 100A was previously punctured.

Figure 3:
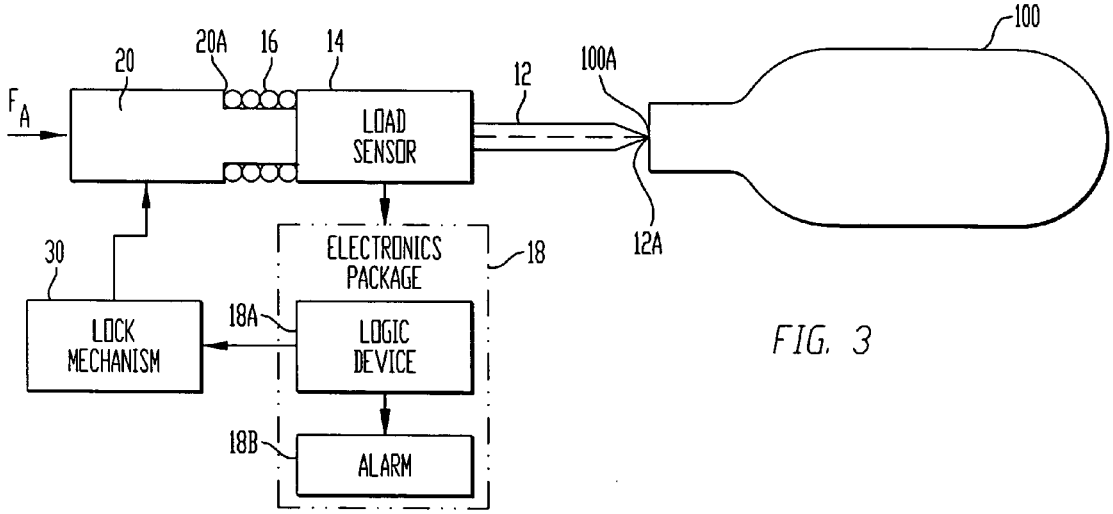
FIG. 3 is a schematic view of the system illustrated in FIG. 2 to further include a mechanism for preventing gas cartridge actuation if the presence of a previously-used gas cartridge is detected.

The present invention could further be adapted to automatically prevent application of the above-described actuation force $F_A$. For example, FIG. 3 illustrates the system shown in FIG. 2 and further includes a lock mechanism 30 coupled to logic device 18A. Lock mechanism 30 is any device that mechanically or electronically prevents drive piston 20 from imparting actuation force $F_A$ to load sensor 14/pin 12 when load sensor 14 detects a spring force $F_S$ of approximately zero. Accordingly, lock mechanism 30 could be realized by a mechanical or electronic lock acting on drive piston 20 to prevent movement thereof even if actuation force $F_A$ is applied thereto. Lock mechanism 30 could also be realized by a device that prevents the actual application of actuation force $F_A$. In this case, lock mechanism 30 could issue a signal to electrically disable the device (not shown) applying actuation force $F_A$ until such time that logic device 18A recognized a value of spring force $F_S$ indicative of a non-actuated gas cartridge 100.

The advantages of the present invention are numerous. The actuation state of a gas cartridge is easily determined by a system that is readily incorporated into existing gas cartridge actuation systems.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A system for determining a gas cartridge's actuation state, comprising:

a puncture pin adapted to have a first end thereof positioned to abut an end of a gas cartridge;

a load sensor coupled to and in line with a second end of said puncture pin;

a spring having a spring force bearing against said load sensor, said spring force being insufficient to cause said puncture pin to be driven through the end of the gas cartridge when the end has not been punctured, and sufficient to cause said puncture pin to be driven through the end of the gas cartridge when the end has already been punctured wherein said spring force is approximately zero after said puncture pin has been driven through the end that has already been punctured; and a means for determining when said spring force is approximately zero coupled to said load sensor.

2. A system as in claim 1 further comprising an alarm joined to said means for determining that is triggered when said spring force is approximately zero.

3. A system as in claim 2 wherein said alarm comprises at least one of a visual alarm, an audio alarm, and a tactile alarm.

4. A system for determining a gas cartridge's actuation state, comprising:

a puncture pin adapted to have a first end thereof positioned to abut an end of a gas cartridge;

a load sensor coupled to and in line with a second end of said puncture pin;

a force applicator capable of applying a force of actuation to said puncture pin via said load sensor, said force of actuation being sufficient to cause said puncture pin to be driven through the end of the gas cartridge;

a spring having a spring force bearing between said load sensor and said force applicator, said spring force being less than said force of actuation, insufficient to cause said puncture pin to be driven through the end of the gas cartridge when the end has not been punctured and when said force of actuation has not been applied, and sufficient to cause said puncture pin to be driven through the end of the gas cartridge when the end has already been punctured but said force of actuation has not been applied, wherein said spring force is approximately zero after said puncture pin has been driven through the end that has already been punctured; and a device coupled to said load sensor for determining when said spring force is approximately zero.

5. A system as in claim 4 wherein said device includes an alarm that is triggered when said spring force is approximately zero.

6. A system as in claim 5 wherein said alarm comprises at least one of a visual alarm, an audio alarm, and a tactile alarm.

7. A system as in claim 4 further comprising a mechanism coupled to said device and said force applicator for preventing said force applicator from applying said force of actuation when said spring force is approximately zero.

8. A system as in claim 7 wherein said mechanism electronically prevents said force applicator from applying said force of actuation when said spring force is approximately zero.

9. A system as in claim 7 wherein said mechanism mechanically prevents said force applicator from applying said force of actuation when said spring force is approximately zero.

10. A system for determining a gas cartridge's actuation state, comprising:

a puncture pin adapted to have a first end thereof positioned to abut an end of a gas cartridge;

a load sensor coupled to and in line with a second end of said puncture pin;

a force applicator capable of applying a force of actuation to said puncture pin via said load sensor, said force of actuation being sufficient to cause said puncture pin to be driven through the end of the gas cartridge;

a spring having a spring force bearing between said load sensor and said force applicator, said spring force being less than said force of actuation, insufficient to cause said puncture pin to be driven through the end of the gas cartridge when the end has not been punctured and when said force of actuation has not been applied, and sufficient to cause said puncture pin to be driven through the end of the gas cartridge when the end has already been punctured but said force of actuation has not been applied, wherein said spring force is approximately zero after said puncture pin has been driven through the end that has already been punctured;

a logic device coupled to said load sensor for determining when said spring force is approximately zero;

an alarm coupled to said logic device for generating an alarm signal when said spring force is approximately zero; and a mechanism coupled to said logic device and said force applicator for preventing said force applicator from applying said force of actuation when said spring force is approximately zero.

11. A system as in claim 10 wherein said alarm comprises at least one of a visual alarm, an audio alarm, and a tactile alarm.

12. A system as in claim 10 wherein said mechanism electronically prevents said force applicator from applying said force of actuation when said spring force is approximately zero.

13. A system as in claim 10 wherein said mechanism mechanically prevents said force applicator from applying said force of actuation when said spring force is approximately zero.

* * * * *